US006133877A

United States Patent [19]

Sandstedt et al.

[11] Patent Number: 6,133,877

[45] Date of Patent: Oct. 17, 2000

[54] MICROSTRIP DISTRIBUTION NETWORK DEVICE FOR ANTENNAS

[75] Inventors: Jonas Sandstedt, Göteborg; Björn Johannisson, Kungsbacka; Göran Snygg, Partille, all of Sweden

[73] Assignee: Telefonaktiebolaget LM Ericsson, Stockholm, Sweden

[21] Appl. No.: 09/005,367

[22] Filed: Jan. 9, 1998

[30] Foreign Application Priority Data

Jan. 10, 1997 [SE] Sweden ..... 9700047

[51] Int. Cl.[7] ..... H01Q 1/38

[52] U.S. Cl. ..... 343/700 MS; 343/771; 333/24 C

[58] Field of Search ..... 343/700 MS, 771, 343/772, 767, 770, 846, 848; 333/24 C, 21 A, 33

[56] References Cited

U.S. PATENT DOCUMENTS

| | | | |
|---|---|---|---|
| 4,725,793 | 2/1988 | Igarashi | 333/26 |
| 4,870,375 | 9/1989 | Krueger, Jr. et al. | 333/33 |
| 4,885,556 | 12/1989 | Lamberty et al. | 333/21 A |
| 5,065,123 | 11/1991 | Heckaman et al. | 333/246 |
| 5,164,358 | 11/1992 | Buck et al. | 505/1 |
| 5,225,796 | 7/1993 | Williams et al. | 333/12 |
| 5,311,159 | 5/1994 | Miura et al. | 333/204 |
| 5,355,143 | 10/1994 | Zurcher et al. | 343/700 MS |
| 5,475,394 | 12/1995 | Kohls et al. | 343/700 MS |
| 5,661,493 | 8/1997 | Uher et al. | 343/700 MS |
| 5,668,558 | 9/1997 | Hong | 343/700 MS |

FOREIGN PATENT DOCUMENTS

| | | | |
|---|---|---|---|
| 0 497 181 | 1/1992 | European Pat. Off. . | |
| 0 743 697 | 11/1996 | European Pat. Off. . | |
| 62-227202 | 10/1987 | Japan . | |
| 1008825 | 3/1983 | U.S.S.R. | 343/700 MS |
| 2 213 995 | 8/1989 | United Kingdom . | |

OTHER PUBLICATIONS

Chiba, Taneaki, et al., "Suppression of Higher Modes and Cross Polarized Component for Microstrip Antenna," IEEE AP Symp., p.285–288 (1982).

Herscovici, Naftali I., et al., "A Microstrip Array Fed by a New Type of Multilayer Feeding Network," Microwave Journal, p124–134 (Jul. 1995).

Herscovici, Naftali I., et al., "Aperture Coupling Between Adjacent Layers Using a New Stripline Geometry[1]", IEEE Microwave and Guided Wave Letters, v., n1, p24–25 (Jan. 1995).

Lee, Choon Sae et al., "Gain Enhancement of a Thick Microstrip Antenna by Suppressing Surface Waves," IEEE AP Symp., p460–463 (1994).

Matsui, A., et al., "A Consideration on Parallel Plate Mode Suppression of Triplate–Type Planar Antenna," IEEE AP Symp., p1218–1221 (1994).

*Primary Examiner*—Tan Ho

*Attorney, Agent, or Firm*—Burns, Doane, Swecker & Mathis, L.L.P.

[57] ABSTRACT

A device for microstrip distribution networks and for group antennas for the suppression of unwanted modes on the distribution network side of a microstrip distribution network. This thereby avoids, among other things, unwanted coupling between antenna elements connected to the microstrip distribution network. A waveguide substructure in principle designed as a U of extruded aluminium, is connected to the microstrip distribution network along two connection lines with at least two electrically-conductive connections to the ground plane of the microstrip distribution network along each connection line. Together with at least part of the ground plane, the waveguide substructure forms a waveguide structure. The waveguide structure is dimensioned so that it has a cut-off frequency that is higher than the highest frequency that is used in the microstrip distribution network. This suppresses unwanted modes generated by the group antenna and by discontinuities in the distribution network as the waveguide structure acts as a high-pass filter.

30 Claims, 2 Drawing Sheets

MICROSTRIP DISTRIBUTION NETWORK DEVICE FOR ANTENNAS

FIELD OF THE INVENTION

This invention concerns devices for microstrip distribution networks, in particular within the field of microstrip antennas for the suppression of unwanted modes. Unwanted modes can, for example, cause coupling between different elements in group antennas. The invention also concerns group antennas with improved characteristics, including those concerning the avoidance of coupling between different antenna elements.

BACKGROUND

Microstrip antennas usually consist of a number of antenna elements and a microstrip distribution network with a ground plane on one side facing towards the antenna elements and a distribution network on the other side. The distribution network sometimes has two separate branches for the connection of two different polarisations of antenna elements. In these different types of antennas and distribution networks unwanted modes arise among other reasons because slots in the ground plane also radiate backwards. Other types of discontinuities also cause unwanted radiation and thereby also unwanted modes. Already-known attempts to solve these problems have involved the introduction of new materials in the laminate of microstrip distribution networks. The article "A Microstrip Array Fed by a New Type of Multilayer Feeding Network", N. I. Herscovici et al., Microwave Journal, July 1995, pp 124–134, describes a method of suppressing unwanted modes by introducing dielectric plugs in the laminate/substrate. The article "Gain enhancement of a thick microstrip antenna by suppressing surface waves", C. S. Lee et al., IEEE AP symposium, 1994, pp 460–463, describes a method of improving microstrip antennas by introducing parasitic elements within the laminate/substrate. These methods are extremely expensive as standard components cannot be used. Introducing new materials into the laminates requires expensive non-standard processing and is therefore not suitable for mass-production.

SUMMARY

One aim of the invention is to define a device for microstrip distribution networks for suppressing unwanted modes that have arisen, for example, as a result of discontinuities in a microstrip distribution network.

Another aim of the invention is to define a microstrip antenna that suppresses unwanted modes so that no coupling or only a small coupling between antenna elements will arise.

A further aim of the invention is to define a group antenna with a small or no coupling between the antenna elements.

An additional aim of the invention is to define a microstrip distribution network for group antennas that does not introduce unwanted modes in the antenna array.

A further aim of the invention is to define a device for microstrip distribution networks that suppresses unwanted modes, that is easy to mass-produce and that uses standard components which are processed in accordance with standardised methods.

The above aims are achieved according to the invention by a device for or of microstrip distribution networks and for or of group antennas for the suppression of unwanted modes on the distribution network side of a microstrip distribution network. This thereby avoids, among other things, unwanted coupling between antenna elements connected to the microstrip distribution network. The microstrip distribution network can be manufactured from a double-sided copper-coated fibreglass laminate that is etched. A waveguide substructure, in principle designed as a U of extruded aluminium, is coupled to the microstrip distribution network along two connection lines by at least two electrically-conductive connections to the ground plane of the microstrip distribution network along each connection line. Together with at least part of the ground plane, the waveguide substructure forms a waveguide structure. The waveguide structure is dimensioned so that it has a cut-off frequency that is higher than the highest frequency that is used in the microstrip distribution network; the waveguide is said to be in "cut-off". This suppresses unwanted modes generated by group antennas and by discontinuities in the distribution network as the waveguide structure is designed to act as a high-pass filter. The waveguide structure is thus not used to feed the distribution network as it does not operate for the frequencies that are used in the microstrip distribution network.

The above aims according to the invention are also achieved by a device for or of microstrip distribution networks for group antennas. The microstrip distribution network distributes and combines at least one electromagnetic signal within a predetermined frequency band and includes a ground plane on a first surface and a distribution network with at least one separate branch on a second surface. The first surface and the second surface are separated by a dielectric and are in principle equidistant from each other. At least two feed points transfer the electromagnetic signals from and/or to the distribution network through the ground plane. This can be carried out to/from a slot in the ground plane that acts as an antenna element, via a slot in the ground plane to/from a patch or to/from antenna elements via an additional one or more distribution networks. A waveguide substructure is set up/arranged associated with the microstrip distribution network and forms part of a waveguide structure. The waveguide structure is dimensioned so that it has a cut-off frequency that is higher than a frequency in the predetermined frequency band for the suppression of unwanted modes generated by group antennas and by discontinuities in the distribution network. The cut-off frequency can suitably be higher than the highest frequency in the predetermined frequency band. The waveguide substructure can suitably be set up in connection with at least one of the feed points. A suitable location of the waveguide substructure and the fact that at least part of the ground plane can advantageously form a demarcation surface for the waveguide structure, results in that at least part of the distribution network is located within the waveguide structure. The waveguide substructure can suitably in principle be shaped as a U.

In a preferred embodiment the waveguide substructure is connected to the microstrip distribution network along two connection lines. Depending upon the application, a variant can suitably be that the waveguide substructure and the ground plane are electrically connected by means of at least one electrically-conductive connection along each connection line. In another application, a variant can be that the waveguide substructure and the ground plane are electrically connected by means of at least two electrically-conductive connections along each connection line and that on a connection line the distance between the electrically-conductive connections is at most half a wavelength in the microstrip distribution network's dielectric of a frequency in the predetermined frequency band. It is preferable that the distance is at most half a wavelength of the highest frequency in the predetermined frequency band. The distance expressed in wavelengths in this description refers, unless stated otherwise, to the length of a wave of a signal where it propagates.

In certain applications it can be required that a waveguide substructure includes at least one opening along and open towards a connection line in order to permit the passage of at least one conductor belonging to the distribution network on the second surface from one side to the other of the connection line along which there is an opening in the waveguide substructure. For optimal functioning an opening can suitably have a length of at most half a wavelength along a connection line in which there is an opening in the waveguide substructure and a depth of at least an eighth of a wavelength in the waveguide substructure from the second surface. In the applications where the waveguide substructure has at least one opening along at least one of the connection lines, the waveguide substructure and the ground plane can suitably be electrically connected by means of at least two electrically-conductive connections along each connection line. Except along the openings on a connection line, the distance between the electrically-conductive connections can suitably be at most half a wavelength of a frequency in the predetermined frequency band, which can preferably be the highest frequency. An opening can have associated electrically-conductive connections on each side of the opening.

Of course microstrip distribution networks can be designed with regard to a waveguide substructure's influence, but a waveguide substructure's demarcation surface can be so designed and dimensioned that the function of the microstrip distribution network is in principal not affected. A suitable way of manufacturing waveguide substructures is using extruded aluminium or some other suitable material. The waveguide substructure can also form part of a box structure on which the microstrip distribution network is installed.

The above aims according to the invention can also be achieved by a group antenna containing at least two antenna elements and a microstrip distribution network. The microstrip distribution network distributes and combines electromagnetic signals within a predetermined frequency band and includes a ground plane on a first surface and a distribution network on a second surface. The first surface and the second surface are separated by a dielectric and are substantially equidistant from each other. At least two feed points are arranged to transfer the electromagnetic signals between the distribution network and the antenna elements through the dielectric. The antenna elements can, for example, be slots in the ground plane or microstrip elements, so-called patches, that are coupled via slots in the ground plane or via coaxial conductors. The antenna elements can also consist of other types of emitters such as dipoles. It is a characteristic of the invention that a waveguide substructure is arranged in association with the microstrip distribution network and forms part of a waveguide structure where the waveguide structure is dimensioned so that it has a cut-off frequency that is higher than a frequency in the predetermined frequency band, which can suitably be the highest frequency. This achieves the suppression of unwanted modes generated by the group antennas and thereby avoids unwanted coupling between antenna elements. The group antenna can, among other things, depending upon the application, be made in a number of different preferred embodiments in accordance to the devices described above.

This invention has a number of advantages for microstrip distribution networks and for group antennas compared to previously-known technology. The invention suppresses mode-propagation and can thereby avoid or reduce couplings between antenna elements that are connected to the microstrip distribution network. This is achieved by a waveguide substructure being installed on the distribution network side of a microstrip distribution network and electrically connected together with the ground plane of the microstrip distribution network. The waveguide substructure together with at least part of the ground plane is dimensioned so that a waveguide structure is created that is in "cut-off" for the frequencies that are used in the microstrip distribution network. The waveguide substructure can suitably be manufactured out of aluminium using extruding equipment, which makes the invention very cost-effective, particularly in long runs. This means that the invention is of interest for base station antennas for mobile telephone systems that are manufactured in large numbers. In accordance with the invention, waveguide substructures can be part of a box structure that carries and protects the microstrip distribution network. In those cases where the microstrip distribution network for example is manufactured from a printed circuit board (for example fibreglass substrate/laminate with etched copper on both sides) the box structure can be simply provided with channels in which the microstrip distribution network is inserted. If an antenna with slot-coupled patches is used as an emitting element with, for example, slots in the ground plane, the box structure can also be provided with channels in which a fibreglass substrate/laminate with the patches can be inserted. The microstrip distribution network can be used together with a number of antenna elements/transmitter elements to form a group antenna. A group antenna can either be one-dimensional with only one stack/column of emitting elements or two-dimensional and is then usually made up of a number of stacks of one-dimensional group antennas. The box structure with the waveguide substructure can easily be designed so that it can also be used for installing the group antenna in its intended position. This invention has a number of advantages concerning both its function and manufacturing aspects.

BRIEF DESCRIPTION OF THE DRAWINGS

In the following the invention will be described in greater detail for the purpose of explanation and in no way for the purpose of restriction, with reference to the attached figures, where.

DETAILED DESCRIPTION

In order to clarify the procedure and the system according to the invention, some examples of its application will be described in the following with reference to the FIGS. 1 to 6.

Figure 1:
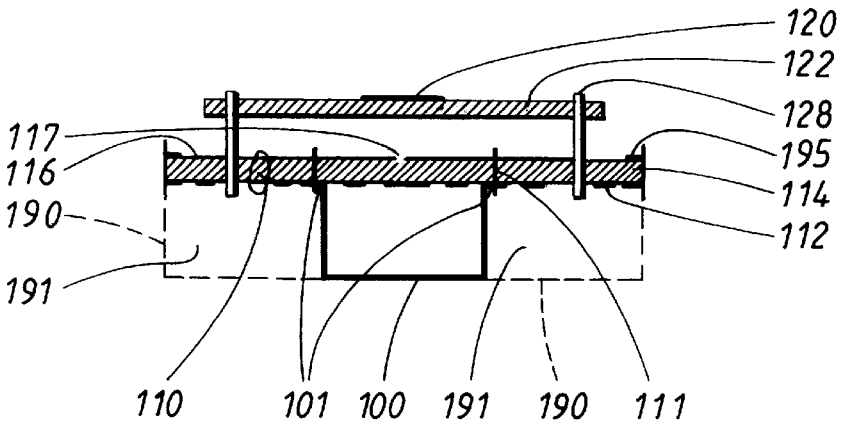
FIG. 1 shows a cross section of a microstrip antenna of a first embodiment with slot-coupled patches and a microstrip distribution network in accordance with the invention.

FIG. 1 shows a cross section of a microstrip antenna designed in accordance with a first embodiment according to the invention. The microstrip antenna is, for example, a one-dimensional group antenna or a stack/column in a two-dimensional group antenna. A microstrip antenna includes a microstrip distribution network 110 with a ground plane 116 on a first surface and a distribution network 112 on a second surface. The ground plane 116 and the distribution network 112 are separated by a dielectric 114 that for example can be a fibreglass laminate or air. It is usual for the microstrip distribution network 110 to be a double-sided copper-coated fibreglass laminate printed circuit board that the distribution network 112 is etched onto. Certain patterns, such as slots, are etched in the ground plane 116. The antenna shown in FIG. 1 uses slot-coupled 117 patches 120 as emitting elements. The patches 120 can be etched on a single-sided copper-coated fibreglass laminate printed circuit board. The fibreglass laminate 122 acts only as a support for the patches 120 and is installed in front of the microstrip distribution network 110 using for example some spacers 128.

According to the invention, a waveguide substructure 100 is installed on the back of the antenna along two connection lines 101 against the second surface of the microstrip distribution network 110. The waveguide substructure 100 is connected electrically with the ground plane 116 in order thereby to create a waveguide structure together with at least part of the ground plane 116. The electrical connection 111 that connects the waveguide substructure 100 with the ground plane 116 can, for example, be achieved with screws or rivets. In order to ensure the intended function the distance between these individual electrical connections 111 should be in the order of at most half a wavelength of the highest frequency that is used in the microstrip distribution network 110. Part of the invention consists precisely of using at least part of a ground plane in a microstrip distribution network in order to create a waveguide structure. The waveguide structure that is created in accordance with the invention has a cut-off frequency that is higher than the highest frequency that is used in the microstrip distribution network 110. This means that the waveguide structure is dimensioned so that it does not work as a waveguide for the frequencies that are used by the microstrip distribution network 110. The waveguide structure is in "cut-off". All the radiation that arises from that part of the distribution network 112 that is within the waveguide structure is thereby greatly suppressed. A slot 117, a feed point, that is to be connected to a patch 120 situated at the front will also radiate backwards and the radiation that is thereby directed into the waveguide structure will be greatly suppressed. If the radiation is not suppressed, unwanted modes could arise that can couple to other slots/feed points and thereby impair the desired antenna characteristic. The dimensioning of the waveguide structure can be carried out easily using, for example, a commercial program using any suitable cross-section surface and desired cut-off frequency.

In some cases it can be appropriate to make the waveguide substructure 100 part of a box structure 190. The box structure can then among other things physically protect the distribution network 112 and also contain channels 195 in which the microstrip distribution network 110 can be inserted. The channels 195 can also include the means for electrically connecting the box structure 190 to the ground plane 116.

Figure 2:
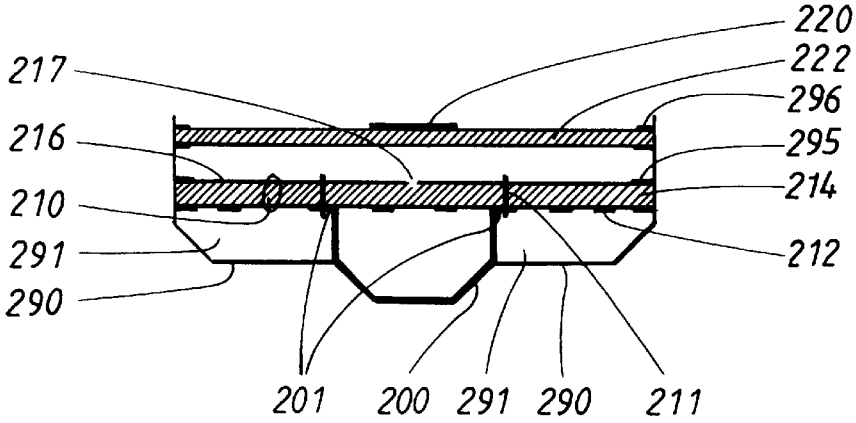
FIG. 2 shows a cross section of a microstrip antenna of a second embodiment with slot-coupled patches and a microstrip distribution network in accordance with the invention.

FIG. 2 shows in a corresponding way a microstrip antenna, designed however in accordance with a second embodiment of the invention. This second embodiment also shows an antenna which uses slot-coupled 217 patches 220 as emitting elements. The microstrip distribution network 210 includes a ground plane 216 and a distribution network 212 which are separated from each other by a dielectric 214. A waveguide substructure 200 is connected to the microstrip distribution network 210 along the connection lines 201. The waveguide substructure 200 is electrically connected to the ground plane 216 by electrically-conducting connections 211 in order to create a waveguide structure in "cut-off" that surrounds at least part of the distribution network 212. Here the waveguide substructure 200 is shown with a form that makes it easy to install either just the microstrip distribution network or the microstrip antenna in a suitable place. Also any box structure 290 is here designed so that not just the microstrip distribution network can be inserted in channels 295 but the support 222 for the patches 220 can also be inserted in its respective channels 296.

If the waveguide substructure 100, 200 is included in a box structure 190, 290 as shown in FIGS. 1 and 2, it is appropriate that the spaces 191, 291 that are created are also dimensioned as waveguide structures in "cut-off" in a corresponding way to that in which the waveguide substructures 100, 200 are dimensioned together with at least a part of the respective ground planes 116, 216.

Figure 3:
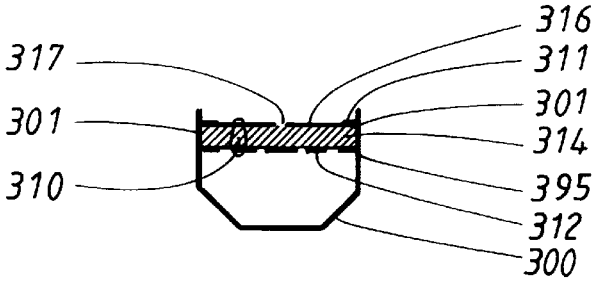
FIG. 3 shows a cross section of a microstrip antenna of a third embodiment in accordance with the invention with slots as antenna elements.

FIG. 3 shows a microstrip antenna according to the invention that only uses slots 317 as antenna elements. The microstrip distribution network 310, its dielectric 314 and also the distribution network 312 in FIG. 3 are relatively smaller than 110 and 210 in FIGS. 1 and 2 on account of the frequency range used, the number of connected antenna elements or for some other reason. The waveguide substructure 300 can therefore be connected to the microstrip distribution network 310 along connection lines 301 that coincide with for example any channels 395 that are used for inserting the microstrip distribution network 310. The waveguide substructure 300 can be connected 311 electrically to the ground plane 316 along the channels 395 and thus no separate electrical connection is required. The connection 311 can for example be designed as a tight fit (possibly using screws or rivets) or with conductive packing or seals. The waveguide structure that is formed is dimensioned so that its cut-off frequency is higher than the frequencies at which the microstrip antenna is used.

The first and the second surfaces on the microstrip distribution networks 110, 210, 310 which are shown in FIGS. 1 to 3 are all shown as flat but there is nothing to prevent these surfaces having a different shape, such as being curved.

Figure 4:
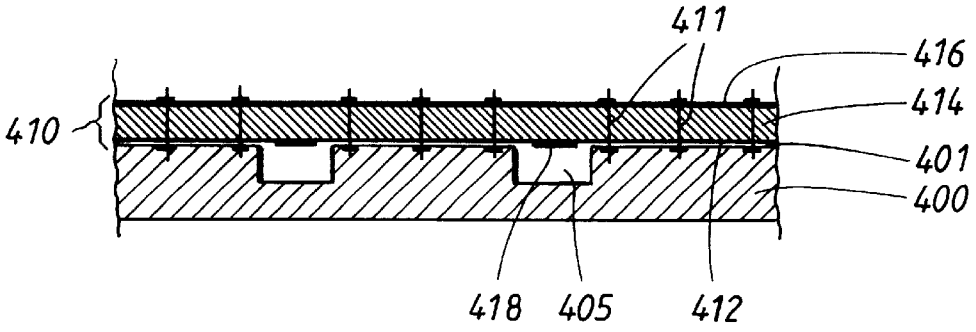
FIG. 4 shows a cross section along a connection line of a microstrip distribution network of an embodiment in accordance with the invention.

In certain applications a large distribution network is required which means that the microstrip distribution network becomes large and wide, which is shown in FIGS. 1 and 2 where the microstrip distribution networks 110, 210 are wider than the respective waveguide substructures 100, 200. In order that the whole width of the microstrip distribution networks 110, 210 are to be able to be used for the distribution networks 112, 212 even though the waveguide substructures 100, 200 are connected along the connection lines 101, 201 to the respective microstrip distribution networks 110, 210, the waveguide substructures 100, 200 contain a necessary number of openings. FIG. 4 shows a cross section along, for example, one of the connection lines 101 or 201 in FIGS. 1 and 2. Part of the microstrip distribution network 410 with a first surface with a ground plane 416 and a second surface with a distribution network 412 is shown in the figure together with part of a waveguide substructure 400. The ground plane 416 and the distribution network 412 are separated by a dielectric 414. The waveguide substructure 400 is connected to the microstrip distribution network 400 along a connection line 401 and electrically connected to the ground plane by means of electrical connections 411. In order to allow conductors 418 on the distribution network 412 to pass from one side of a connection line 401 to the other without being subject to interference from the waveguide substructure 400 it is provided with a necessary number of openings 405. The openings can have a width of at most half a wavelength and a depth of at least an eighth of a wavelength (wavelengths in the openings that normally only comprises air).

Figure 5:
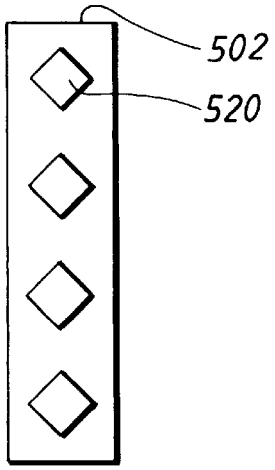
FIG. 5 shows a one-dimensional group antenna with double-polarised patches for the polarisations ±45° as antenna elements.
Figure 6:
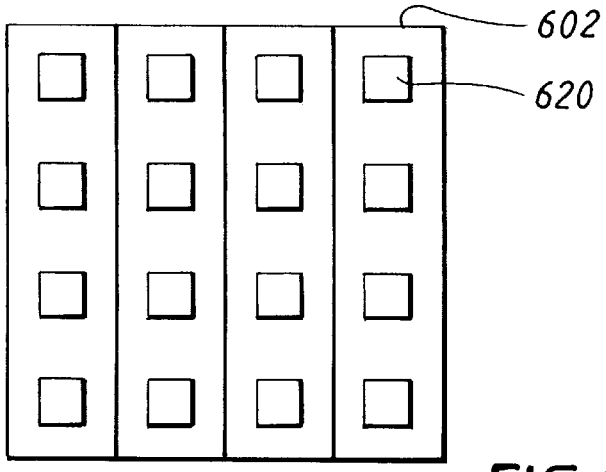
FIG. 6 shows a two-dimensional group antenna with double-polarised patches for the polarisations 0°/90° as antenna elements.

FIGS. 5 and 6 show examples of group antennas. FIG. 5 shows a one-dimensional group antenna with only one stack/column 502 with antenna elements 520. These antenna elements can transmit and receive two linear polarisations in the planes ±45° relative to the long side of the antenna. FIG. 6 shows a two-dimensional group antenna with a number of stacks/columns 602 with antenna elements 620 for the polarisations 0° and 90°.

The invention concerns group antennas and in particular microstrip antennas and the suppression of unwanted modes that can arise in these. Above, examples of how unwanted modes can be suppressed greatly using a waveguide structure in "cut-off", have been described. The waveguide structure utilises at least part of the ground plane in a microstrip network and thus becomes an integrated structure with this. We have also described how waveguide structures with waveguide substructures can be designed in a flexible way in order to make possible cost-effective mass production. The erection of group antennas with individual stacks and also the assembly of several individual stacks for two-dimensional group antennas can be made easier using the ability to design the waveguide substructures flexibly.

The invention is not restricted to the embodiments described above, but can be varied within the framework of the appended patent claims.

What is claimed is:

1. Device for microstrip distribution networks for group antennas where the microstrip distribution network distributes and combines at least one electromagnetic signal within a predetermined frequency band and comprises a ground plane on a first surface and a distribution network with at least one separate branch on a second surface, where the first surface and the second surface are divided by a dielectric and substantially equidistant from each other, whereby at least two feed points transfer the electromagnetic signals between the distribution network and a group antenna's antenna elements through the ground plane, the device comprising a waveguide substructure arranged in association with the microstrip distribution network and forming part of a waveguide structure where the waveguide structure is dimensioned so that it has a cut-off frequency that is higher than a frequency in the predetermined frequency band for the suppression of unwanted modes generated by the group antenna and by discontinuities in the distribution network.

2. Device according to claim 1, wherein the cut-off frequency is higher than the highest frequency in the predetermined frequency band.

3. Device according to claim 1, the waveguide substructure is arranged in association with at least one of the feed points.

4. Device according to claim 1, at least part of the distribution network is situated within the waveguide structure.

5. Device according to claim 1 wherein the waveguide substructure is substantially shaped as a U.

6. Device according to claim 1 wherein at least part of the ground plane forms a demarcation surface for the waveguide structure.

7. Device according to claim 6, wherein the waveguide substructure is connected to the microstrip distribution network along two connection lines.

8. Device according to claim 7, wherein the waveguide substructure and the ground plane are electrically connected by at least one electrically-conductive connection along each connection line.

9. Device according to claim 7, wherein the waveguide substructure and the ground plane are electrically connected by at least two electrically-conductive connections along each connection line and on a connection line the distance between the electrically-conductive connections is at most half a wavelength in the microstrip distribution network's dielectric of a frequency in the predetermined frequency band.

10. Device according to claim 7, wherein the waveguide substructure comprises at least one opening along and open towards a connection line in order to make possible the passage of at least one conductor belonging to the distribution network on the second surface from one side to the other of the connection line along which there is an opening in the waveguide substructure.

11. Device according to claim 10, wherein the opening has a length of at most half a wavelength along a connection line on which there is an opening in the waveguide substructure and a depth of at least an eighth of a wavelength in the waveguide substructure from the second surface.

12. Device according to claim 10, characterised wherein the waveguide substructure and the ground plane are electrically connected by at least two electrically-conductive connections along each connection line and except along openings on a connection line, the distance between the electrically-conductive connections is at most half a wavelength of a frequency in the predetermined frequency band, and an opening has, connected to it, electrically-conductive connections on each side.

13. Device according to claim 1, wherein a demarcation surface of the waveguide substructure is so designed and dimensioned that the function of the microstrip distribution network is in principle not affected.

14. Device according to claim 1, wherein the waveguide substructure is manufactured out of extruded aluminium.

15. Device according to claim 1, wherein the waveguide substructure forms part of a box structure upon which the microstrip distribution network is installed.

16. Group antenna comprising at least two antenna elements and a microstrip distribution network that distributes and combines electromagnetic signals within a predetermined frequency band and that comprises a ground plane on a first surface and a distribution network on a second surface, where the first surface and the second surface are divided by a dielectric and substantially equidistant from each other, whereby at least two feed points transfer the electromagnetic signals between the distribution network and antenna elements through the ground plane, and a waveguide substructure arranged in association with the microstrip distribution network and forming part of a waveguide structure where the waveguide structure is dimensioned so that it has a cut-off frequency that is higher than a frequency in the predetermined frequency band for the suppression of unwanted modes generated by the group antenna in order to thereby avoid unwanted coupling between antenna elements.

17. Group antenna according to claim 16, wherein the cut-off frequency is higher than the highest frequency in the predetermined frequency band.

18. Group antenna according to claim 16 wherein the waveguide substructure is arranged in association with at least one of the feed points.

19. Group antenna according to claim 16, wherein at least part of the distribution network is situated within the waveguide structure.

20. Group antenna according to claim 16, wherein the waveguide substructure is substantially shaped as a U.

21. Group antenna according to claim 16, wherein at least part of the ground plane forms a demarcation surface for the waveguide structure.

22. Group antenna according to claim 21, wherein the waveguide substructure is connected to the microstrip distribution network along two connection lines.

23. Group antenna according to claim 22, wherein the waveguide substructure and the ground plane are electrically connected by at least one electrically-conductive connection along each connection line.

24. Group antenna according to claim 22, wherein the waveguide substructure and the ground plane are electrically connected by at least two electrically-conductive connections along each connection line and on a connection line the distance between the electrically-conductive connections is at most half a wavelength in the microstrip distribution network's dielectric of a frequency in the predetermined frequency band.

25. Group antenna according to claim 22, wherein the waveguide substructure comprises at least one opening along and open towards a connection line in order to make possible the passage of at least one conductor belonging to the distribution network on the second surface from one side to the other of the connection line along which there is an opening in the waveguide substructure.

26. Group antenna according to claim 25, wherein the opening has a length in the order of at most half a wavelength along a connection line on which there is an opening in the waveguide substructure and a depth of at least an eighth of a wavelength in the waveguide substructure from the second surface.

27. Group antenna according to claim 25, wherein the waveguide substructure and the ground plane are electrically connected by at least two electrically-conductive connections along each connection line and except along openings on a connection line the distance between the electrically-conductive connections is at most half a wavelength of a frequency in the predetermined frequency band, and an opening has, connected to it, electrically-conductive connections on each side.

28. Group antenna according to claim 16, wherein a demarcation surface of the waveguide substructure is so designed and dimensioned that the function of the microstrip distribution network is in principle not affected.

29. Group antenna according to claim 16, wherein the waveguide substructure is manufactured out of extruded aluminium.

30. Group antenna according to claim 16, wherein the waveguide substructure forms part of a box structure upon which the microstrip distribution network is installed.

* * * * *